United States Patent [19]

Stranzke et al.

[11] Patent Number: 4,982,561

[45] Date of Patent: Jan. 8, 1991

[54] UPWARD TWISTING MACHINE, IN PARTICULAR DOUBLE TWISTING MACHINE

[75] Inventors: Günter Stranzke; Rolf D. Weber; Erich Jenter, all of Kempten, Fed. Rep. of Germany

[73] Assignee: Saurer-Allma GmbH, Kempten, Fed. Rep. of Germany

[21] Appl. No.: 453,981

[22] Filed: Dec. 20, 1989

[30] Foreign Application Priority Data

Dec. 20, 1988 [DE] Fed. Rep. of Germany ..... 3842783

[51] Int. Cl.[5] ..... D01H 1/10; D01H 7/08

[52] U.S. Cl. ..... 57/62; 57/58.83; 242/18 DD; 242/35.5 A

[58] Field of Search ..... 57/58.49, 58.83, 58.3, 57/58.36, 59, 62, 63; 242/18 R, 18 DD, 35.5 A

[56] References Cited

U.S. PATENT DOCUMENTS 4,856,270 8/1989 Langen et al. ..... 57/281
4,878,342 11/1989 Kawarabashi ..... 242/18 DD X

FOREIGN PATENT DOCUMENTS 1685944 8/1974 Fed. Rep. of Germany .
2624459 12/1976 Fed. Rep. of Germany .

OTHER PUBLICATIONS

Schlafhorst brochure entitled "Autoconer 238", Apr. 1988, 24 pp.

*Primary Examiner*—Joseph J. Hail, III
*Attorney, Agent, or Firm*—Flynn, Thiel, Boutell & Tanis

[57] ABSTRACT

The upward twisting machine, in particular double twisting machine, comprises for each twisting point a creel (3) and an associated take-up cylinder (6) as well as a carrying arm which is pivotable about a pivot axis arranged on the vertical longitudinal centre plane (M) and extending parallel thereto, which carries the creel (3). The pivot axis (5) of the carrying arm (4) is provided in the region below the conveyor belt (2). The pivot radius (R) of the bobbin axis (S) of a take-up bobbin (7) held in the creel (3) is dimensioned relative to the pivot axis (5) in such a way that the line of contact (B) between the bobbin winding and the take-up cylinder (6) is always located on the side facing towards the vertical longitudinal center plane (M), of a vertical plane (V) passing through the axis (A) of the take-up cylinder (6). Furthermore, a cover plate (9) sloping downwards the conveyor belt (2) is provided between the take-up cylinder (6) and the conveyor belt (2).

7 Claims, 4 Drawing Sheets

UPWARD TWISTING MACHINE, IN PARTICULAR DOUBLE TWISTING MACHINE

FIELD OF THE INVENTION

The invention concerns an upward twisting machine, in particular double twisting machine, with a creel provided for each twisting point and an associated take-up cylinder, each with a carrying arm one end of which is pivotable about a pivot axis arranged at least in the vicinity of the vertical longitudinal centre plane and extending parallel thereto and the other end of which is connected to the creel, and with a transfer device for the transfer of full bobbins from the creel onto an endless conveyor belt extending in the longitudinal centre plane.

BACKGROUND OF THE INVENTION

In case of double twisting machines, there are endeavours to produce larger take-up bobbins which also have a correspondingly higher weight. These heavy take-up bobbins are difficult to handle, on account of which there are endeavours to transfer the take-up bobbins by means of a transfer device from the creel onto the conveyor belt running in the centre of the machine. In the case of an upward twisting machine of the kind mentioned hereinbefore (German Pat. No. 1 685 944), the actual creel which receives the take-up bobbin is pivotably connected to the end of the carrying arm. During winding, the creel can be locked in a given angular position relative to the carrying arm by a locking device. This locking device can be released when the bobbin is full, whereupon the carrying arm is pivoted towards the conveyor belt. The take-up bobbin in this case rolls over the take-up cylinder, or the movement of the creel can be controlled by a four-bar mechanism in such a way that the take-up bobbin is lifted above the take-up cylinder without contact. After opening the creel, the full take-up bobbin can drop onto the conveyor belt. In a development of this known upward twisting machine, the pivot axis of the carrying arm is arranged above the leading roller and the creel is located in the region between the leading roller and the take-up cylinder. Free access to the thread guiding parts is prevented not only by the carrying arm and the creel, but also by the take-up bobbin which increases in diameter during the winding process. Moreover, with this development the pivot radius of the bobbin axis of a take-up bobbin held in the creel is relatively small compared with the pivot axis of the carrying arm. From experience, however, this pivot radius should be as large as possible. In another embodiment of this known upward twisting machine, the pivot axis of the carrying arm is arranged at a greater height above the conveyor belt in the vertical longitudinal centre plane of the machine. As a result the overall height of the machine becomes relatively great and operation of the machine is made difficult. Moreover with this development it is difficult to provide a conveyor arranged above the machine for the supply of stock bobbins. Both embodiments furthermore have the disadvantage that the creel has to be pivotably connected to the carrying arm and there must also be at least one locking device. These additional structural components make the machine more expensive.

It is the object of the invention, while avoiding the above disadvantages, to provide an upward twisting machine, in particular double twisting machine, of the kind mentioned hereinbefore, in which free access to the thread guiding parts is ensured and in which no parts project beyond the take-up bobbin, so that it has a low overall height.

According to the invention this is achieved by the fact that the pivot axis of the carrying arm is provided in the region below the conveyor belt and that the pivot radius of the bobbin axis of a take-up bobbin held in the creel is dimensioned relative to the pivot axis in such a way that the line of contact between the bobbin winding and the take-up cylinder is always located on the side facing towards the vertical longitudinal centre plane, of a vertical plane passing through the axis of the take-up cylinder.

Due to the arrangement of the pivot axis of the carrying arm in the region below the conveyor belt, that is, at the centre of the machine, a particularly low overall height is obtained. No part of the carrying arm or of the creel projects beyond the take-up bobbin. Consequently a feeder for stock bobbins can without difficulty be arranged above the twisting machine at a level which is relatively low and hence also convenient to reach. As the carrying arm and the creel are arranged in the region between the take-up cylinder and the vertical longitudinal centre plane of the machine, free access to the thread-guiding parts from the operating side of the machine is ensured at any time.

A particularly advantageous development of the upward twisting machine consists in that the axis of the take-up cylinder is located above a horizontal plane of transport passing through the conveyor belt and that a cover plate sloping downwards towards the conveyor belt is provided as the transfer device between the take-up cylinder and the conveyor belt.

A similar construction is of course known from the aforementioned German Pat. No. 1 685 944. However, special advantages arise in combination with the characteristics of the upward twisting machine according to the invention. For the fact is that the creel can be rigidly connected to the carrying arm, whereby one joint and one locking device are saved. As the bobbin axis of the take-up bobbin in the device according to the invention is always located between a vertical plane passing through the axis of the take-up cylinder and the vertical longitudinal centre plane of the machine, the bobbin axis of the full take-up bobbin is located above the obliquely inclined cover plate. When the creel is opened, the take-up bobbin drops onto the cover plate and then rolls automatically onto the conveyor belt. Due to elimination of the pivot joint and the locking device, the production costs of the machine are lowered.

Further advantageous developments of the invention are discussed below.

BRIEF DESCRIPTION OF THE DRAWINGS

The invention is explained in more detail below with reference to practical examples shown in the drawings, in which.

DETAILED DESCRIPTION

Figure 1:
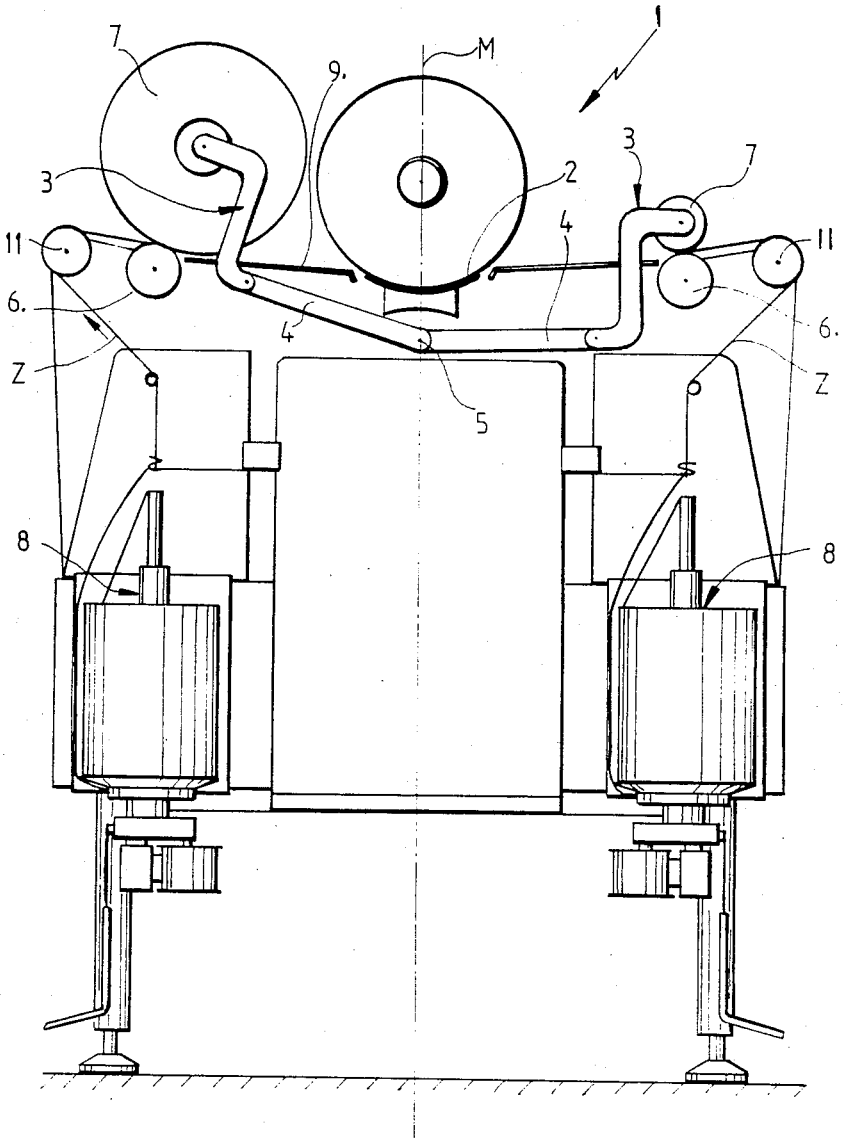
FIG. 1 is a cross-section of a first practical example of a double twisting machine according to the invention.
Figure 2:
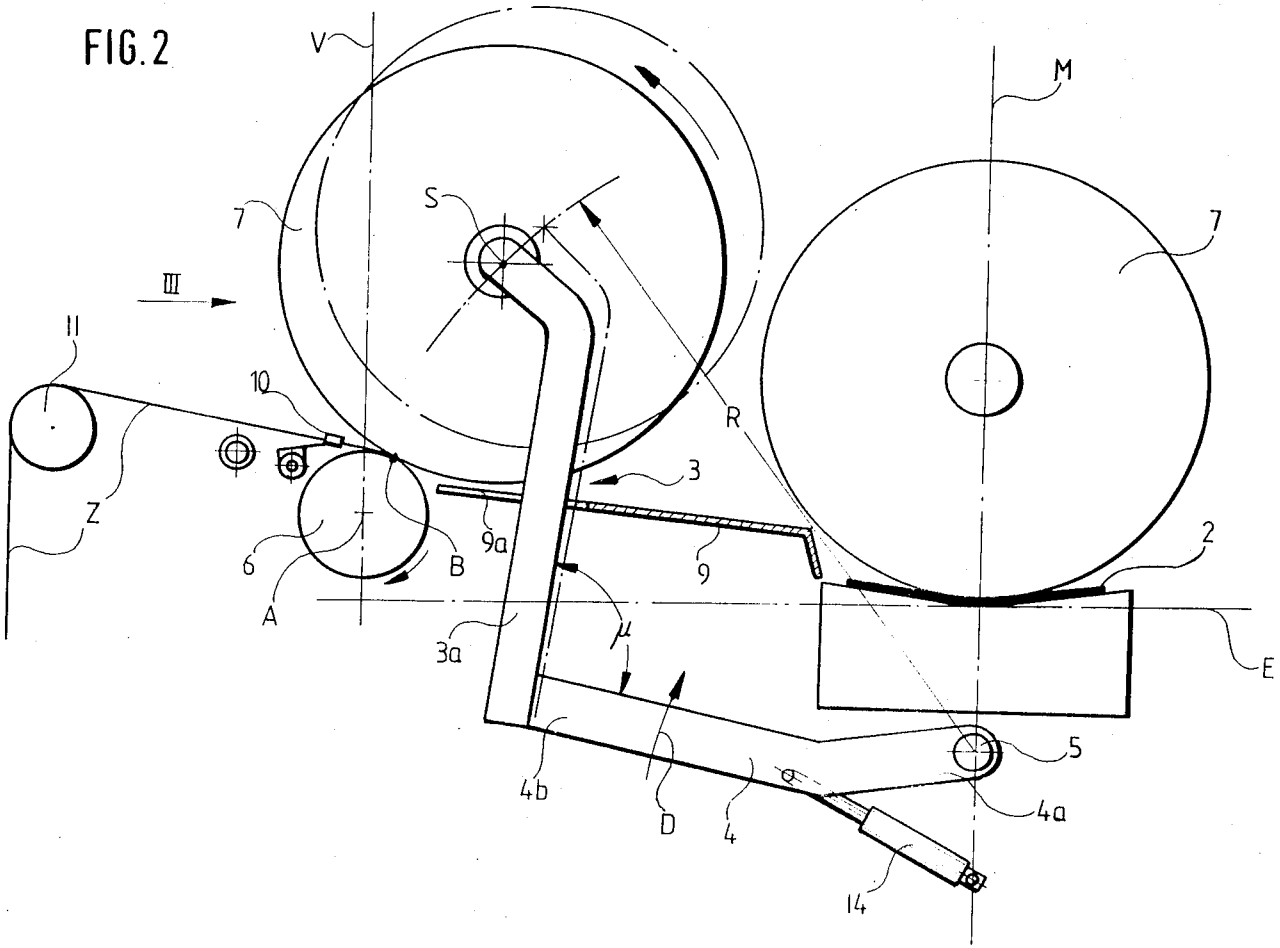
FIG. 2 illustrates details of the take-up device thereof on a larger scale.

In the drawings, 1 denotes a double twisting machine which comprises in its upper region an endless conveyor belt 2 or the like conveying device. The endless conveyor belt 2 extends in the vertical longitudinal centre plane M of the machine, which has a structure symmetrical to the longitudinal centre plane M. As the structural components of a double twisting machine are well known, only the take-up device, which is specially designed in the double twisting machine according to the invention, is described in more detail below. This comprises at each twisting point a creel 3 and a carrying arm 4 therefor. One end 4*a* of the carrying arm is mounted pivotably about a pivot axis 5 which is appropriately arranged in the vertical longitudinal centre plane M. The essential thing here is that this pivot axis 5 is provided below the region of the conveyor belt 2. The other end 4*b* of the carrying arm 4 is rigidly connected to the creel 3 in this practical example. A take-up cylinder 6 is also associated with each creel 3. A take-up bobbin 7 held rotatably in the creel is supported by its bobbin winding on the take-up cylinder 6. The yarn Z coming from the double twisting spindle 8 is guided over the leading roller 11 and during the winding process is reciprocated in the longitudinal direction of the machine by the cross winding thread guide 10, which also reciprocates in the longitudinal direction of the machine. The take-up bobbin 7 is driven by the take-up cylinder 6 in the direction of the arrow, rotating about the bobbin axis S. The pivot radius R of the bobbin axis S of a take-up bobbin 7 held in the creel 3 is dimensioned relative to the pivot axis 5 in such a way that the line of contact B between the bobbin winding and the take-up cylinder 6 is always located on the side facing towards the vertical longitudinal centre plane M, of a vertical plane V passing through the rotational axis A of the take-up cylinder 6.

Furthermore, the axis A of the take-up cylinder 6 is arranged above a plane of transport E passing through the conveyor belt 2 or at a tangent to it. In this way the circumference of the take-up cylinder 6 is located higher than the plane E. Between the take-up cylinder 6 and the conveyor belt 2 is provided a cover plate 9 sloping downwards towards the conveyor belt 2. As described in more detail below, the cover plate serves as a transfer device for the transfer of a full take-up bobbin 7 from the creel 3 to the conveyor belt 2.

Figure 3:
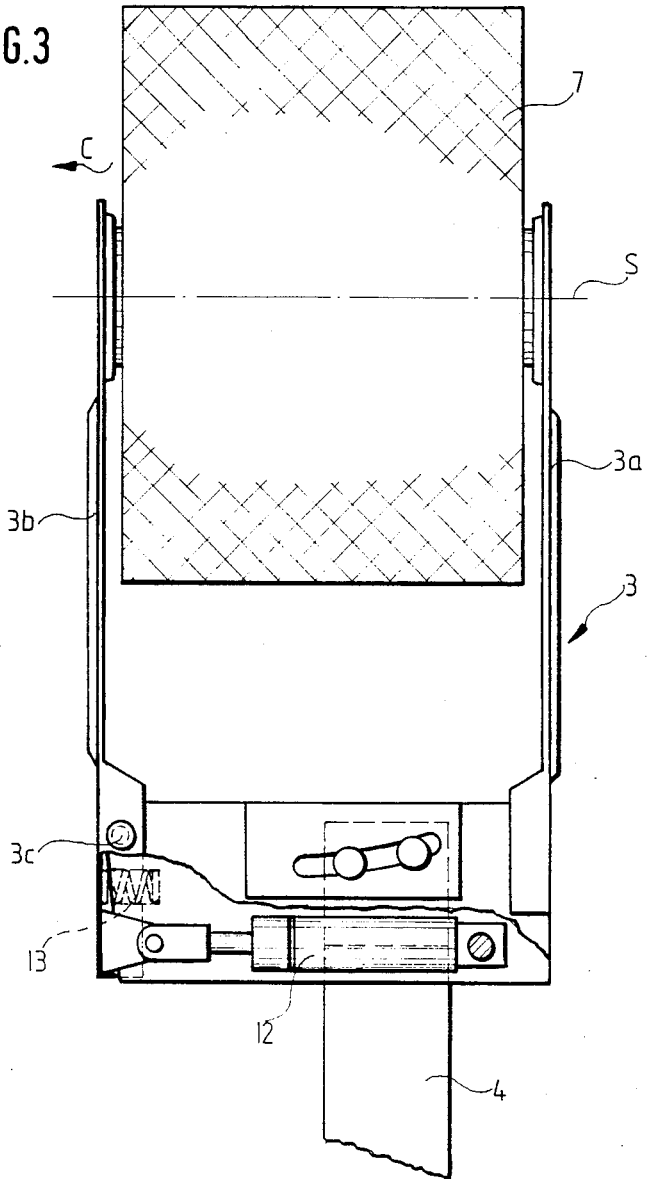
FIG. 3 is a the front view of the creel taken in direction III of FIG. 2.

As can be seen from FIG. 3, the creel 3 comprises in a known manner a rigid creel arm 3*a* and a creel arm 3*b* pivotable about the axis 3*c*. This creel arm 3*b* is biassed by the spring 13 towards the take-up bobbin 7. Appropriately a pneumatic cylinder 12 is provided, which against the force of the spring 13 pivots the pivotable creel arm 3*b* in direction C away from the take-up bobbin 7, and thus opens the creel 3 and releases the take-up bobbin 7.

The carrying arm 4 remains below the cover plate 9 in each of its pivot positions. The creel arms 3*a*, 3*b* form with the carrying arm 4 an angle $\mu$ of about 90°–130°, so that their free ends extend into a region above the cover plate 9. The cover plate 9 comprises a slot 9*a* for passage of each of the creel arms 3*a*, 3*b*. Furthermore, a pneumatic cylinder 14 is to be provided for lifting the take-up bobbin 7 off the take-up cylinder 6. This pneumatic cylinder 14 is controlled by a thread monitor or length counter, not shown. If there is a thread breakage during twisting, the thread monitor causes the admission of compressed air to pneumatic cylinder 14. The latter lifts the carrying arm 4 and hence also the creel 3 into the position shown in dot-dash lines, whereby the take-up bobbin 7 is lifted off the take-up cylinder 6 and thus stopped. The same happens if the preset number of meters is reached on the take-up bobbin 7 and the length counter gives the order to supply compressed air to pneumatic cylinder 14. After the creel 3 and the take-up bobbin 7 have reached the position shown in dot-dash lines, the creel is opened by means of pneumatic cylinder 12 and hence the take-up bobbin is released. The take-up bobbin 7 drops onto the cover plate 9 and then rolls automatically onto the conveyor belt 2. The latter conveys the full take-up bobbin to one end of the machine. Instead of pneumatic cylinder 12, the movable creel 3 could in a known manner be provided with an operating lever, not shown, with which the creel 3 would then have to be opened by hand.

Figure 4:
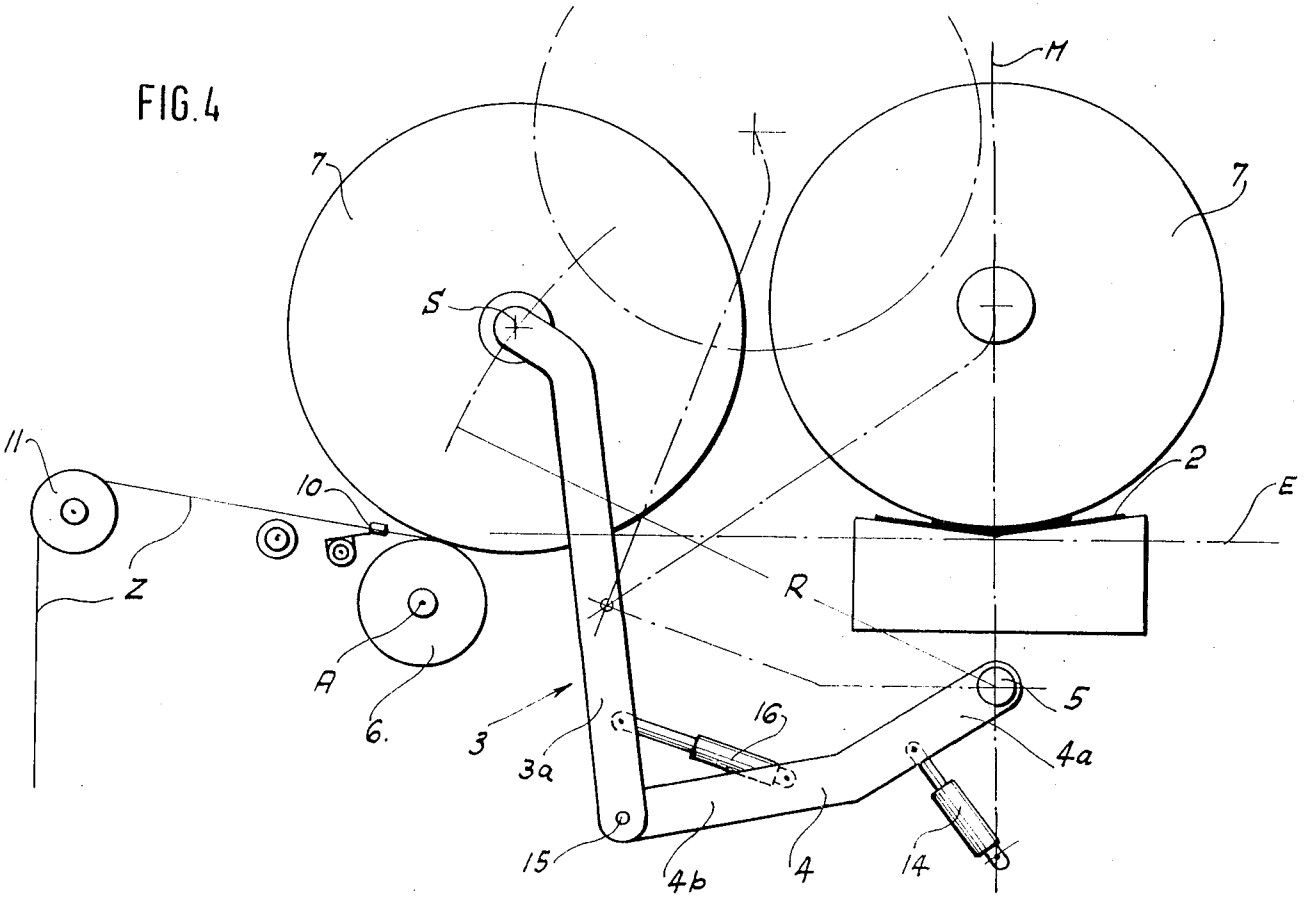
FIG. 4 shows a second practical example of the invention, in cross-section.

In the practical example shown in FIG. 4, parts with the same function are marked with the reference numbers used in the practical example described above, and the above description also applies analogously to the practical example shown in FIG. 4. In this practical example the end 4*b* of the carrying arm 4 is connected to the creel 3 by a hinge pin 15 extending parallel to the pivot axis 5. Between the carrying arm 4 and the creel 3 is also arranged a pneumatic cylinder 16. In this practical example the axis A of the take-up cylinder 6 can be arranged below the plane of transport E and a cover plate can be eliminated. During the winding process and also in case of thread breakages, pneumatic cylinder 16 holds the creel 3 in a predetermined angular position relative to the carrying arm 4. For transfer of a full take-up bobbin 7 onto the conveyor belt 2, the carrying arm 4 is first pivoted upwards into the position shown in dot-dash lines by means of pneumatic cylinder 14, maintaining the predetermined angular position between creel 3 and carrying arm 4. Then pneumatic cylinder 16 lowers the creel 3 towards the conveyor belt 2 into the position shown in double dot-dash lines, whereupon the creel is opened by means of pneumatic cylinder 12. As a result the full take-up bobbin can drop directly onto the conveyor belt 2 and then be transported by the latter to one end of the machine.

We claim:

1. In an upward double twisting machine for transferring elongate ropelike members from twisting stations to respective take-up bobbins, including a carrying arm for each twisting station, means for defining a pivot axis at one end of said carrying arm, said pivot axis being arranged adjacent a vertical longitudinal center plane of said twisting machine and extending parallel thereto, said carrying arm being pivotable about said pivot axis through a range of pivotal movement, a creel for carrying said take-up bobbin being connected to another end of said carrying arm, said creel including means for supporting said take-up bobbin for rotation about a bobbin axis, a take-up cylinder for each twisting station, means for supporting said take-up cylinder for rotation about a rotational axis adjacent said bobbin, an endless conveyor belt which intersects and extends parallel to said vertical longitudinal center plane, said rotational axis of said take-up cylinder being located above a horizontal conveying plane defined by said endless conveyor belt, and a cover plate inclining downwardly from said take-up cylinder toward said endless conveyor belt for transferring full bobbins from said creel onto said endless conveyor belt, the improvement comprising:

said endless conveyor belt overlying said pivot axis of said carrying arm, a pneumatic cylinder for effecting pivotal movement of said carrying arm, means for stationarily supporting one end of said pneumatic cylinder, another end of said pneumatic cylinder being connected to said carrying arm, said creel including a pair of creel arms connected to said another end of said carrying arm and forming an angle in the range of 90° to 130° with said carrying arm, said cover plate having a slot therein for permitting passage of each said creel arm therethrough, said carrying arm being positioned below said cover plate and remaining below said cover plate throughout said range of pivotal movement thereof, and said bobbin axis and said rotational axis of said take-up cylinder being parallel to and respectively spaced from said pivot axis such that a line of tangential contact between said take-up cylinder and a bobbin winding on said bobbin is always located between said vertical longitudinal center plane and another vertical plane passing through said rotational axis of said take-up cylinder.

2. The machine according to claim 1, wherein the pivot axis is arranged in the vertical longitudinal centre plane.

3. The machine according to claim 1, wherein one said creel arm is supported for pivotal movement, and wherein a further pneumatic cylinder is provided for pivotally moving said one creel arm to open said creel.

4. In an upward double twisting machine for transferring elongate ropelike members from twisting stations to respective take-up bobbins, including a carrying arm for each twisting station, means for defining a pivot axis at one end of said carrying arm, said pivot axis being arranged adjacent a vertical longitudinal center plane of said twisting machine and extending parallel thereto, said carrying arm being pivotable about said pivot axis through a range of pivotal movement, a creel for carrying said take-up bobbin being connected to another end of said carrying arm, said creel including means for supporting said take-up bobbin for rotation about a bobbin axis, a take-up cylinder for each twisting station, means for supporting said take-up cylinder for rotation about a rotational axis adjacent said bobbin, an endless conveyor belt which intersects and extends parallel to said vertical longitudinal center plane, and a transfer device for transferring full bobbins from said creel to said endless conveyor belt, the improvement comprising:

said endless conveyor belt overlying said pivot axis of said carrying arm, a first pneumatic cylinder for effecting pivotal movement of said carrying arm, means for stationarily supporting one end of said first pneumatic cylinder, said first pneumatic cylinder having another end connected to said carrying arm, a hinge pin extending through said creel and said another end of said carrying arm for pivotally connecting said creel and said carrying arm, said hinge pin extending parallel to said pivot axis of said carrying arm, a second pneumatic cylinder having one end attached to said carrying arm and another end attached to said creel for effecting relative pivotal movement between said creel and said carrying arm, and said bobbin axis and said rotational axis of said take-up cylinder being parallel to and respectively spaced from said pivot axis such that a line of tangential contact between said take-up cylinder and a bobbin winding on said bobbin is always located between said vertical longitudinal center plane and another vertical plane passing through said rotational axis of said take-up cylinder.

* * * * *